United States Patent [19]

Rüdenauer et al.

[11] 4,241,662

[45] Dec. 30, 1980

[54] ELECTRICAL PROJECTILE DETONATOR

[75] Inventors: Werner Rüdenauer, Roth; Ralf Siewert, Nuremberg, both of Fed. Rep. of Germany

[73] Assignee: Diehl GmbH & Co., Nuremberg, Fed. Rep. of Germany

[21] Appl. No.: 943,106

[22] Filed: Sep. 18, 1978

[30] Foreign Application Priority Data

Oct. 15, 1977 [DE] Fed. Rep. of Germany ..... 2746599

[51] Int. Cl.[3] ..... F42C 11/02

[52] U.S. Cl. ..... 102/210

[58] Field of Search ..... 102/210

[56] References Cited

U.S. PATENT DOCUMENTS

| | | | |
|---|---|---|---|
| 2,514,297 | 7/1950 | Smith, Jr. et al. | 102/210 |
| 2,972,306 | 2/1961 | Kabik et al. | 102/210 |
| 3,101,054 | 8/1963 | Stevenson et al. | 102/210 |

FOREIGN PATENT DOCUMENTS

| | | | |
|---|---|---|---|
| 1145522 | 3/1963 | Fed. Rep. of Germany | 102/210 |
| 6404577 | 2/1965 | Netherlands | 102/210 |

*Primary Examiner*—Charles T. Jordan

*Attorney, Agent, or Firm*—Scully, Scott, Murphy & Presser

[57] ABSTRACT

An electrical projectile detonator, particularly a base detonator or fuse which incorporates a piezoceramic cell as a current generator wherein it is possible to generate a voltage through the intermediary of the gas pressure of a pyrotechnic explosive charge. The piezoceramic cell is arranged in a tail-ended cup-like recess of the projectile base, or in a threaded base, so as to be positioned against an intermediate base element serving as an anvil and covered by a pressure plate, which by means of the gas pressure of the projectile impelling charge acting on a tail-ended closure disc or the like during the discharge of the projectile, can be pressed against the piezoceramic cell.

8 Claims, 5 Drawing Figures

ELECTRICAL PROJECTILE DETONATOR

BACKGROUND OF THE INVENTION

1. Field of the Invention

The present invention relates to an electrical projectile detonator, particularly a base detonator or fuse, which incorporates a piezoceramic cell as a current generator wherein it is possible to generate a voltage through the intermediary of the gas pressure of a pyrotechnic explosive charge.

2. Discussion of Prior Art

In electric projectile detonators incorporating a piezoceramic cell as the current generator, the cell as well as a pressure plate located axially adjacent thereto is mostly so arranged that the cell either at projectile discharge—under the effect of inertial forces—or upon impact against a target, is exposed to a pressure or impact load and as a result there is generated therein the electrical energy required for the detonation of the explosion charge. For this purpose, the cell is arranged in the detonator, for example in either the tip thereof, but occasionally also in its base.

In addition thereto it is also known, for instance from German Laid-Open Patent Publication No. 22 06 646, that the required mechanical pressure energy for the generation of the electrical energy can be generated through a pyrotechnic explosive charge.

While the forces which occur during projectile discharge acceleration are adequate, in a piezoceramic cell, to generate the voltage required for detonation, this energy is frequently insufficient to also be able to supply further switching circuits which may occasionally be present in the detonator. An electrical current source according to the above-mentioned German published patent application, in turn requires its own pyrotechnic explosive charge, as well as an additional detonator device.

SUMMARY OF THE INVENTION

Accordingly, it is an object of the present invention to provide a current generator for an electric projectile detonator of the above-mentioned type which is also as simply constructed as presently known current generators operating with inertial forces, but which provides a substantially higher power output.

In accordance with the present invention, the foregoing object is inventively attained in that the electrical projectile detonator has the piezoceramic cell arranged in a tail-ended cup-like recess of the projectile base, or in a threaded base, so as to be positioned against an intermediate base element serving as an anvil and covered by a pressure plate, which by means of the gas pressure of the projectile impelling charge acting on a tail-ended closure disc or the like during the discharge of the projectile, can be pressed against the piezoceramic cell.

Thus, serving as the energy source is the gas pressure of the impelling charge through the intermediary of which there is fired or discharged the projectile. The electrical energy which hereby can be generated in the peizoceramic cell is a multiple in comparison with that in a piezoelectric generator which is supplied with an inertial force; thereby, for this generator no more components or additional space is required as would be for a usual, essentially weaker powered piezoelectric generator actuated through inertial force. Due to its small dimensions it is also suitable for ammunition having smaller calibers such as, for example, diameters of 28 or 35 mm. In addition thereto, a generator of this type is generally insensitive to external or foreign influences and rough handling and the like. Due to its arrangement and the rigid connection with the projectile body, the piezoceramic cell provides the possibility of being utilized not only as the detonating current generator at the discharge of the projectile, but also as a sensor upon impact against the target, namely for activation of the detonating medium. Finally, this solution also allows for the arrangement of two superimposed piezoelectric current generators, since the piezoceramic cell ideally is pressed through the pressure plate and thereby the energy flow is conducted in the same manner to a subsequent cell; provided thereby is a doubling of the electrical charge.

In accordance with another characteristic of the present invention, through the provision of an interspace between the closure disc and the pressure plate limiting the displacement of the former rearwardly, in a unique manner the charging voltages generated in the piezoelectric cell by rattling movements, falls, impacts or the like are held remote from the detonation system or, respectively, a charging condenser. The foregoing provides that a sufficient voltage can only then be generator when the pressure acting on the closure disc is so high that the closure disc moves beyond the interspace. Transport shocks and the like can here be presently held mechanically distant from the generator whereby the detonator will be secure during manual manipulation and in its function.

In another aspect of the present invention, the condition of impact-like acoustic waves traversing the solid body, such as loading shocks, will not lead to either charging voltages nor to voltage impulses capable of causing electrical switching. An explosive powder charge of a projectile which is located against the closure disc due to impact loads will have shock loads acting on the projectile absorbed by the closure disc when produced during the conveyance of the weapon into, respectively, the shell chamber. This subject matter will absolutely secure an electronic detonating circuit until the firing of the projectile. Only then will there be generated the voltage by means of the gas pressure. Thus, this subject matter operates in the sense of a main circuit switch and, as a result, simplifies the detonator electronics. This detonator thus generates a charging voltage only first at the firing of the projectile and then only, as required, a trigger voltage at impact. Precluded prior to projectile firing will be the generation of a trigger voltage which would exert an effect on the detonator electronics and could thereby cause a malfunction of the detonator.

In accordance with a further aspect of the present invention, a surprisingly simple construction of the detonator is facilitated in that an elastic ring serves concurrently as a tolerance compensator and spacer between the pressure plate and a contact foil.

Furthermore, pursuant to another aspect of the invention, the contact foil is provided with resilient lugs causing the electric contact to the cell and, as a result, the electric current circuit to remain present subsequent to generating of the charging voltage. By means of the impelling gas pressure which is lacking during the projectile flight, due to the elastic spring-back of the closure disc, there is increased the distance between the cell and the closure disc. This change in the spacing is compensated for by the resilient lugs. Thereby, the cell can be utilized again at impact against a target inasmuch as it generates a trigger voltage.

BRIEF DESCRIPTION OF THE DRAWINGS

Reference may now be had to the following detailed description of three preferred embodiments of the invention, taken in conjunction with the accompanying drawings; in which.

DETAILED DESCRIPTION

Figure 1:
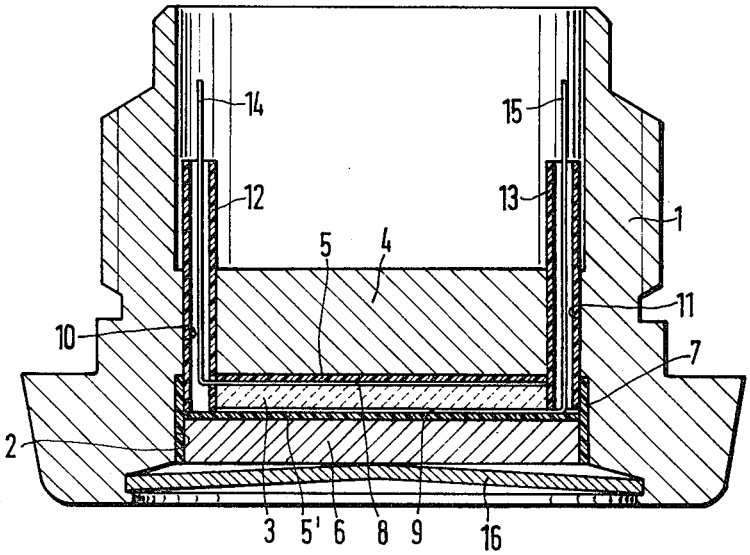
FIG. 1 illustrates a longitudinal section through the threaded base portion of a projectile, in effect through a base detonator including a piezoelectric current generator constructed pursuant to the invention.

Pursuant to FIG. 1 of the drawings, the piezoelectric current generator can be built into the base or tail end of a projectile, or threadable into the threaded base 1, for example, a base detonator. Instead into a rear, cup-like recess 2 is a piezoceramic cell 3 with insulating material plates 5, 5' so as to axially support itself against an intermediate base element 4 of the threaded base 1 which serves as an anvil, i.e. detonator anvil. Lying against the cell 3, while separated therefrom by the insulating material plate 5' or the like, is a pressure plate 6 which is centrally retained in a ring 7 formed of an insulating material. From the contact coatings 8, 9 of this cell 3, connector wires 14, 15 lead inwardly to the fuse or detonator system, and namely through bores 10, 11 of the intermediate base 4 in which there are provided insulating sleeves 12, 13. Towards the rear, the recess 2 is sealed off through the intermediary of a closure disc 16 which is flanged into the threaded base 1. The closure disc is curved inwardly and is prestressed so as to centrally lie against the pressure plate 6.

Figure 2:
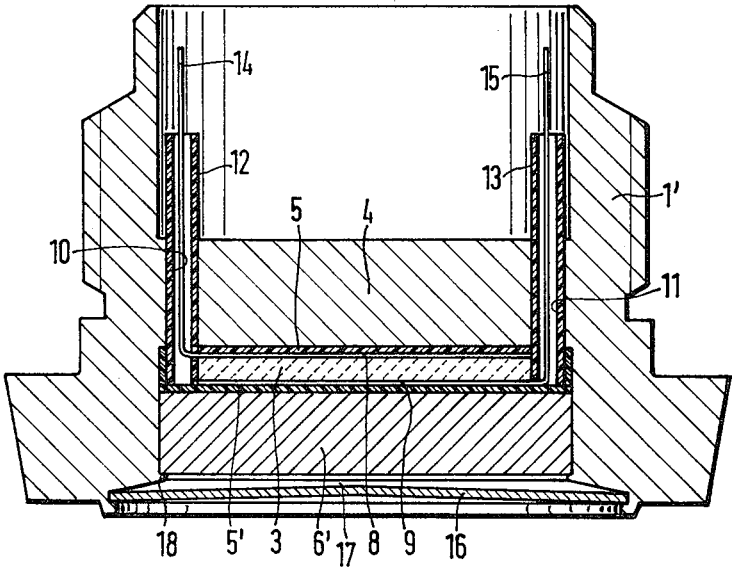
FIGS. 2 and 3, respectively, illustrate further embodiments of the invention.

However, in accordance with FIG. 2 of the drawings, a small space, meaning an interspace 17, can be provided between the closure disc 16 and the pressure plate 6'. The pressure plate 6' itself is then secured against rearward movement in the threaded base 1' by means of flanged rim 18.

The manner of operation of the piezoelectric current generator illustrated in FIGS. 1 and 2 may, essentially, be ascertained from the drawings. At the firing or discharging of the projectile, the gas pressure of the impelling charge 35 will cause the deformable closure disc 16 to be driven against the pressure plate 6, 6'. The pressure plate will press the piezoceramic cell 3 in a cup-shape manner against the intermediate base element 4 and generate therein a voltage in conformance with the peak of the gas pressure. Since the closure disc 16 is thereby subjected to deformation and generally uniformly pressed over the entire surface against the pressure plate 6, 6', the piezoelectric cell 3 is also imparted a generally uniform pressure over the entire surface so as not to be destroyed at the firing of the projectile. This facilitates the piezoelectric cell 3 to be used a second time after firing of the projectile, namely as an impact sensor, whereby the shock wave which occurs at impact will, for example, traverse the cell 3 through the projectile and the intermediate base element 4.

In order to maintain voltages which are generated in the piezoceramic cell produced by jolting movements, drop, impact and the like, remote from the detonating system, such as a charging condenser, the cell 3 has a known electrical gate connected to its output in a manner not illustrated herein, which will only convey a voltage pulse when a predetermined minimum potential is exceeded. Since the voltage generated by the gas pressure lies substantially above that generated by transport impacts or shocks, a separation can be accomplished without difficulty. The detonator is thereby absolutely secure with respect to manipulation and functioning.

A similar threshold or gating effect is attained in a mechanical manner pursuant to the construction of FIG. 2. In this embodiment, a sufficient voltage can first be generated in the cell 3 when the pressure acting on the closure disc 16 is so high to cause the disc to exceed the interspace 17. Loading shocks and the like may hereby be mechanically held remote from the generator.

Figure 4:
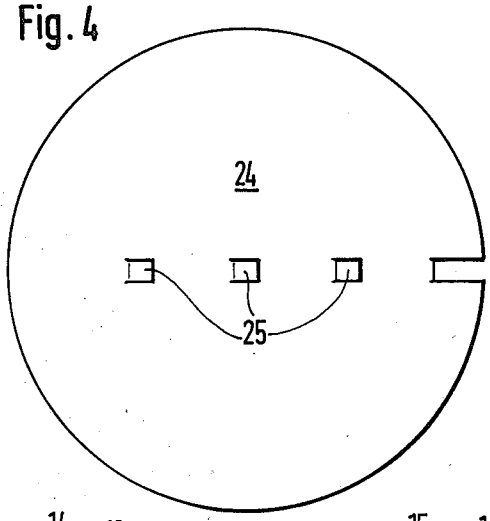
FIG. 4 illustrates the detail of a contact foil as utilized in FIG. 3.
Figure 3:
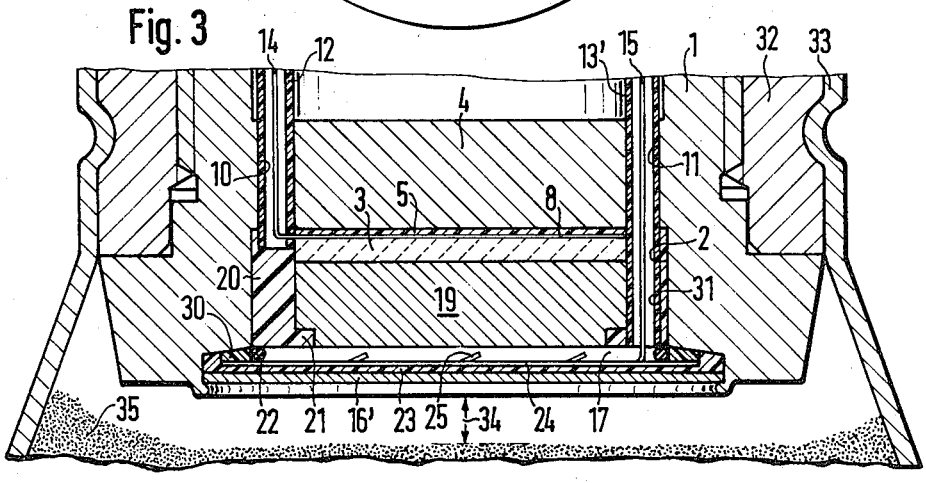

According to FIG. 3 of the drawings, located against the cell 3 which evidences only one contact coating 8, is an electrically-conductive pressure plate 19 (aluminum). An electrically-insulating sleeve 20 having a flange 21 retains the cell 3 and the pressure plate 19 above an elastic ring 22. The ring 22 is supported by means of the closure disc 16' which is flanged into the threaded base 1. Arranged between the ring 22 and the closure disc 16' is a plate 23 of an insulating material and a contact foil 24 with resilient lugs 25 (produced through stamping), as shown in FIG. 4, and a connector wire 15. Located intermediate the tips of the lugs and the pressure plate 19 is the interspace 17. An insulating ring 30 supports the contact foil 24. An insulating sleeve 13' extends into bores 11, 31. The threaded base 1 is screwed together with a projectile cartridge 32. The latter is connected with a cartridge case 33. Arranged at a distance 34 is the impelling powder charge 35.

Figure 5:
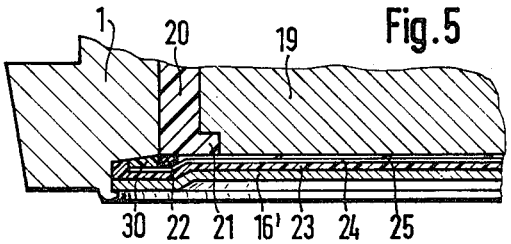
FIG. 5 is a fragmentary portion of FIG. 3 illustrating the detonator of the projectile in an operative state.

In accordance with FIG. 5 of the drawings, the gas pressure of the impelling charge 35 deforms the closure disc 16' in a cup-shaped manner and, with maximum possible surface area, presses the cell 3 across the interposed components 23, 24 against the intermediate base element 4. A charge voltage is generated in accordance with the peak of the gas pressure. At some time after the gas pressure peak has been reached, the thus plastically deformed closure disc 16' springs somewhat back, however, the lugs 25 compensate for change in the spacing. The electrical contact thereby remains intact. Thereby, at impact against a target through the sound wave produced by the solid body there is additionally generated a trigger impulse.

In a known manner, not illustrated herein, for increasing the voltage, as well as for increasing the operational dependability of the generator, a plurality of piezoceramic cells may be arranged, for example, in a tandem or superimposed manner, in the space between the pressure plate 6, 6', 19 and the intermediate base element 4.

We claim:

1. In an electrical projectile detonator, particularly a base detonator, including a piezoceramic cell as a current generator; and a pyrotechnic impelling charge adapted to produce a gas pressure for generating a voltage in said cell; the improvement comprising: a cup-shaped recess being formed in the tail end of the projectile base, said piezoceramic cell being arranged in said recess; an intermediate base element in said projectile base constituting an anvil contacted by said cell; a pressure plate enclosing said cell in said recess; and a closure disc in the tail end of said projectile base, said closure disc being constituted of a deformable material and inwardly curved towards said piezoceramic cell, said closure disc further being prestressed and flanged into the tail end of said projectile base, said pressure plate being pressable against said piezoceramic cell responsive to the gas pressure of the projectile impelling charge acting on said closure disc at the discharge of said projectile.

2. A detonator as claimed in claim 1, said closure disc being constituted of metal.

3. A detonator as claimed in claim 1, said closure disc having the curved side thereof in movement-restricted contact with said pressure plate.

4. A detonator as claimed in claim 1, comprising an interspace being provided intermediate said closure disc and said pressure plate in the limited rearward path of movement of said pressure plate.

5. A detonator as claimed in claim 4, said pressure plate being constituted of an electrically-conductive material, said pressure plate being in contact with said piezoceramic cell; an elastic contact foil in said interspace fastened to said closure disc so as to be deflectable therewith in said projectile base; and an insulating plate separating said elastic contact foil from said pressure plate.

6. A detonator as claimed in claim 5, comprising an electrically-insulating sleeve enclosing said piezoceramic cell and said pressure plate; and an elastic ring, said sleeve being retained in said elastic ring at a distance from said contact foil.

7. A detonator as claimed in claim 5, said contact foil including projecting lugs wherein the distance to the free end of said lugs towards said pressure plate represents said interspace.

8. A detonator as claimed in claim 1, said projectile base comprising a threaded base member.

* * * * *